US005191682A

United States Patent [19]

Davis-Reardon et al.

[11] Patent Number: 5,191,682

[45] Date of Patent: Mar. 9, 1993

[54] APPARATUS FOR PROVIDING A BADGE FINDING

[75] Inventors: Beverly J. Davis-Reardon, Addison; Elizabeth M. Gomez, Wood Dale; Andru J. Ryniec, Addison, all of Ill.

[73] Assignee: Ambrit, Inc., Elk Grove, Ill.

[21] Appl. No.: 641,186

[22] Filed: Jan. 15, 1991

[51] Int. Cl.[5] ..... A44C 3/00

[52] U.S. Cl. ..... 24/13; 24/304; 40/1.5

[58] Field of Search ..... 24/12, 13, 6, 103, 304; 40/1.5, 1.6; 63/20

[56] References Cited

U.S. PATENT DOCUMENTS

| | | | |
|---|---|---|---|
| 1,785,186 | 12/1930 | Day | 40/1.5 |
| 1,849,904 | 3/1932 | Bett | 40/1.5 |
| 3,257,747 | 6/1966 | Schimmel . | |
| 3,806,997 | 4/1974 | Niwa . | |
| 3,810,321 | 5/1974 | Kiba . | |
| 3,953,910 | 5/1976 | Farb . | |
| 3,996,679 | 12/1979 | Warneke . | |
| 4,020,575 | 5/1977 | Kruger et al. . | |
| 4,155,183 | 5/1979 | Abrahams . | |

FOREIGN PATENT DOCUMENTS

| | | | |
|---|---|---|---|
| 2305812 | 10/1976 | France | 40/1.5 |

*Primary Examiner*—James R. Brittain

*Attorney, Agent, or Firm*—Fitch, Even, Tabin & Flannery

[57] ABSTRACT

A method of manufacture of a badge and badge finding comprises the provision of a backer body with an S-shaped cavity into which is inserted an S-shaped portion of a pin. A double-sided adhesive cover is applied to the backer body to cover the cavity and thereby prevent the S-shaped portion of the pin from leaving the cavity. A liner covers the adhesive on the outer side of the cover. When the badge finding is to be fastened to an article such as a badge body, the liner is removed and the exposed adhesive is pushed against the badge body thereby completing the badge. Thus, the badge may be easily and quickly assembled without messy gluing, molding, welding or crimping. These badge findings may be brought to a trade show and affixed to different kinds of name tags or name badges without the use of a press, a welding machine or messy gluing operations.

6 Claims, 1 Drawing Sheet

APPARATUS FOR PROVIDING A BADGE FINDING

FIELD OF THE INVENTION

The present invention is directed to a method and apparatus for providing a badge finding. More particularly, the present invention is directed toward a badge finding that is less expensive and easier to assemble, stock and use.

BACKGROUND OF THE INVENTION

A badge is commonly used in order to display some article by attachment to clothing. These display articles are commonly identification badges, ribbons and many others. Generally, the badge consists of an article for display to which a badge finding is attached. A common practice in the industry for making the badge finding is to secure a pin to a backer and then the completed badge finding is attached to the display article. However, the methods used to achieve a cost effective, but acceptable badge finding, have not been entirely accomplished. The methods used in prior badge findings have varied, but none offer the dealers and consumers much flexibility in application uses or most importantly a cost advantageous alternative to limited usage of the conventional badge finding. Users often print name badges or other badge face plates for a particular customer and often for very small orders. The users would prefer that whatever they print be easily connected to a badge finding that is universal to the different mediums they print and which can be applied easily and inexpensively without the use of tools that require melting or gluing. Based on the vast usages of badges comes a strong desire for an efficient, flexible, and safe badge finding and method for the same.

For example, prior badge findings, such as disclosed in U.S. Pat. No. 3,953,910, have molded a portion of the pin in a fluent area on the badge face plate. More specifically, this method requires that the badge face plate be of a thermoplastic material and that a tool be used to heat the plastic to a temperature sufficient to melt the thermoplastic of which the backer is formed. Then, a portion of the pin is placed in the melted material which solidifies and forms a secure fastening between the backer and the pin. Many users print on paper or paper stock materials rather than plastic, and this system is not applicable to paper. Additionally, many users either do not have or do not want to be bothered with melting and fusing equipment, as required by this system.

In another method, as disclosed in U.S. Pat. No. 4,155,183, the backer has an upper and lower slot receiving a pin-clip combination made from a single portion of wire. The pin-clip combination gives the consumer an alternate clip to use for attachment. The clip allows the consumer to fasten the badge without puncturing the clothing material. However, this method requires that the slots receiving the pin-clip combination be pre-attached to the badge. Further, this invention is directed to a badge generally used for identification cards and does not always provided secure attachment to clothing when the clip is used. Hence, this method limits the users in flexibility in badge and badge finding applications because the display articles have pre-manufactured requirements.

In a third method, as disclosed in U.S. Pat. No. 3,806,997, a badge or broach has an arm-receiving groove for receiving a mounting arm portion and a coiled spring portion of a pin. Then, a cover is fastened over the spring and secured with a glue to the badge or broach. The badge includes a plastic body and is usable with flat, printed paper stock. This system lacks a badge finding for attachment to a badge face and requires a glue to securely attach the pin to the badge body.

A fourth method includes a backer, a pin and a backup plate. The backer has a plurality of studs protruding from the back side which receive the backup plate. The backup plate, in cooperation with an adhesive, secures the pin to the backer. This method requires time-consuming and messy gluing operations.

A final method is disclosed in U.S. Pat. No. 4,020,575, in which a pin is inserted behind a triangular-shaped, flat flap in the badge finding. Then welding is used to weld the flap to secure the pin, and welding is used to secure the badge finding to the badge face. Thus, this method requires a welding device.

Overall, these methods require the display article to be glued, molded or welded to the badge finding. These methods are generally very messy and time consuming. Also, in these prior methods, if the users assemble the badge, they generally will be required to purchase special machines for the assembling procedures, such as heating and welding devices. Further, these machines generally require periodic maintenance adding additional costs to the user and consumer.

Most users are small and cannot afford the extra time and mess associated with assembling badges and badge findings. Further, the users generally do not desire purchasing the special machines necessary for assembly. An ideal badge finding for these small users provides them with an alternative to having an inventory of pre-fabricated badge findings and completed badges. The badge of the present invention permits users to have one badge finding for almost all their display articles. Further, the badge finding of the present invention allows users the advantage of assembling badges and badge findings as needed to fit their customer desires. This alternative method relieves the user of a large inventory expense or a very limited inventory and in some cases both.

More specifically, many of the prior badge findings require users to stock specific badges. This required inventory restricts the users' flexibility in how and what type of badges can be stored mainly due to cost limitations. Generally, users are unable to stock every type of badge finding and badge possibly desired. A large inventory can result in loss of profit, because some badges requiring special badge findings could go out of style resulting in left over inventory.

Furthermore, if the user refused to use the high inventory method to preserve flexibility, an alternative would be to purchase the required equipment to assemble the badge findings; however, this preservation would sacrifice profits or cause the price to increase in order to retain flexibility in merchandise. These methods generally require extra time, increased manufacturing expenses, costly tools, or more importantly, increased product costs.

Another important consideration is the use of a pin prohibiting accidental release. But, the consumer must be able to easily release the pin. For example, persons with large hands, elderly persons, or persons with arthritis must be capable of easily using the pin. Many of the commonly used pins have a latch device which can come undone with no warning to the consumer. Further, these latch devices are hard to hook generally requiring a steady hand in order not to prick the finger trying to fasten the pin. Thus, it is important that this pin be easy to fasten along with being safe. The present invention uses a pin which can be fastened safely and easily while insuring against accidental release.

The present invention enables the user to easily and quickly assemble the badge finding without messy gluing, molding or welding. Further, this present invention can be attached to many articles, such as plastics ribbons, metals and paper or cardboard materials. Overall, the badge finding of the present invention can be attached to just about any reasonable display article. The present invention provides the user with an unlimited badge finding that has many cost and safety advantages.

From the foregoing, it will be seen that the present invention is directed to providing a new badge finding which the user can easily and quickly assemble that will not accidentally release from clothing. A further object is to decrease the cost to the user. Another object of the present invention is to provide a badge finding which can be attached to many different materials without breaking off. A final objective of the present invention is to increase the users' flexibility in inventory without increasing the inventory cost. These considerations and many more are important features of the badge finding of the present invention.

These and other objects will become more apparent from the following detailed description and the appended claims.

SUMMARY OF THE INVENTION

The present invention is directed to a method for manufacturing a badge and badge finding which can be used to display articles. The badge finding of the present invention can be easily and quickly assembled, thereby reducing cost and labor involved in manufacture of the badge.

More specifically, the badge finding has a backer body having a predetermined configured cavity on one side which receives a pin. The pin is secured to the backer body by placing a central portion of a pin into a cavity in the backer body and applying a cover to secure the pin within the backer body. An adhesive is used to secure the cover to the backer body. Preferably, the adhesive used is on one side of a double-sided adhesive with a liner, where one side secures the pin to the backer body, and the other side allows the badge finding to be fastened to the display article. The present invention is assembled quickly and easily without gluing, welding, and specific manufacture prefabrication. The present invention provides a badge finding which is capable of being attached to display articles made of almost any material, such as wood, glass, plastic, metal, paper or cardboard.

Moreover, the present invention gives badge users the advantage of not having to stock a large inventory of prefabricated badge findings and completed badges. The user can quickly assemble a badge as needed because the user stocks the badge finding along with pieces to assemble a badge. This method reduces the dealer's inventory and manufacturing costs which are associated with a prefabricated badges and badge findings.

BRIEF DESCRIPTION OF THE DRAWINGS

The present invention is described in connection with the accompanying drawings, which illustrate the preferred embodiments and details of the invention, and in which.

DETAILED DESCRIPTION OF THE INVENTION

Figure 1:
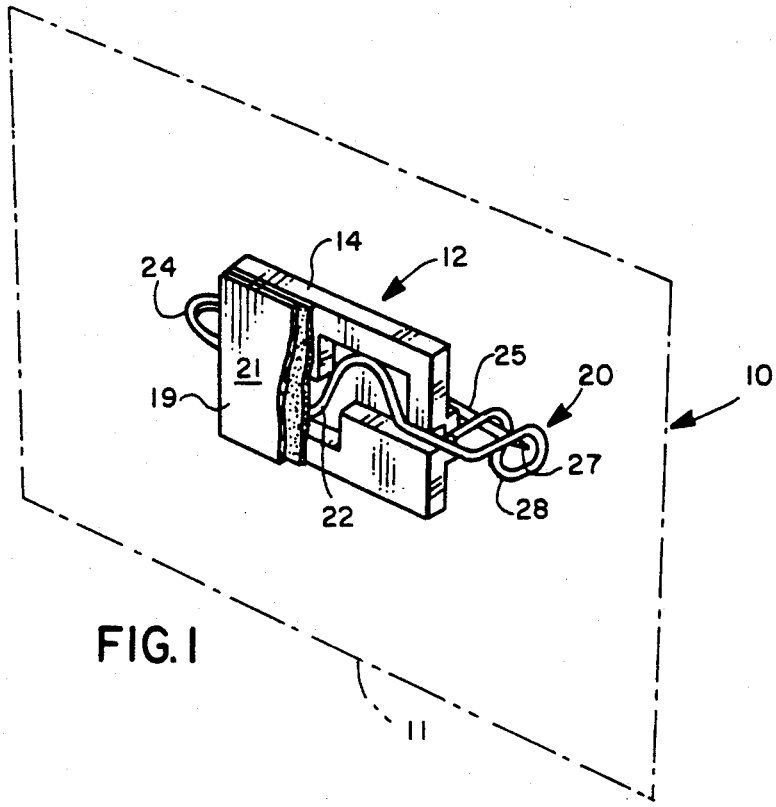
FIG. 1 is a perspective view of a badge using a badge finding embodying principles of the present invention.

A badge 10 as shown in FIG. 1 includes a badge finding 12 for attaching an enlarged badge face or article (shown in phantom) by a fastener, such as a pin 20, to clothing or the like. The badge finding includes a backer body 14 which supports the pin 20 and is connected to the badge face. It is often desired that the badge finding be sold separately for later attachment to a name plate, a badge, or other article that is to be pinned to clothing of the wearer.

Generally, the assembly methods require that the pin be glued or welded to the backer body. Further, the attachment of the badge finding to the display article requires gluing, molding or welding. The gluing, molding or welding procedures are generally messy and require precious time. Further, these badge assembly methods are generally very costly to the user and the consumer whereby the user has to purchase more expensive pre-assembled badges or badge findings, or the user has to purchase and maintain equipment that a small user may not want to purchase or to have available.

In accordance with the present invention, a less expensive badge finding is provided by eliminating the costly assembly methods and the requirement of prefabricated badges. Referring now to the drawings for purposes of description, and not limitation, a full assembled badge 10 using a badge finding apparatus 12 of the present invention is illustrated in FIG. 1. Badge finding 12, as will be seen, carries a pin 20 and can be readily attached to the badge face or article 11 by use of a pressure sensitive, double-sided adhesive 19 on a carrier or cover 21. The badge finding 12 includes a backer body 14, having a cavity 16, a pin 20 and double sided adhesive layers 19 and 22 on opposite sides of a foam carrier layer 23.

Figure 2:
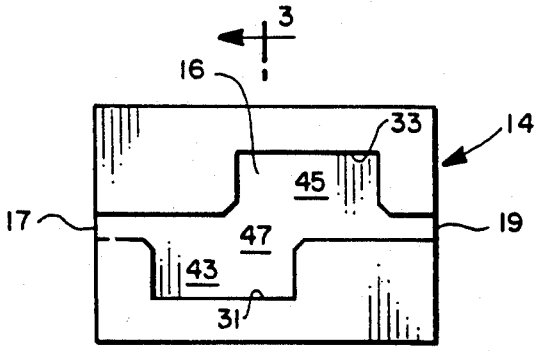
FIG. 2 is an elevational view of the backer body.
Figure 3:
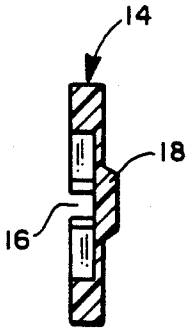
FIG. 3 is a cross-sectional view of the backer body taken along the line 3—3 of FIG. 2.

Referring now to FIGS. 2-3, the preferred backer body 14 is a unitary molded plastic body of plastic, such as high impact polystyrene. On one side, the backer body 14 has a cavity 16 for receiving a pin means, on the other side a support rib 18. As can be seen, the cavity 16 has a S-shaped configuration capable of receiving a pin portion with similar configuration. The cavity has a depth slightly larger than the diameter of the metal wire forming the pin 20. The cavity is formed from a plurality of cavities linked together. A pair of rectangular cavities 43 and 45 are connected through an open corner, represented by the number 47 shown in FIG. 2; and at the ends of cavity 16 are slots 17 and 19. The width of these slots is slightly less than the diameter of the wire forming pin 20 in order to provide a tight press fit between the backer body 14 and the pin 20 at these locations. The tight press fit prevents the pin 20 from any translational movement about the cavity 16 of the backer body 14. Further, the tight press fit assists in assembly procedures by maintaining the pin 20 in the proper position until the adhesive is properly applied.

Figure 4:
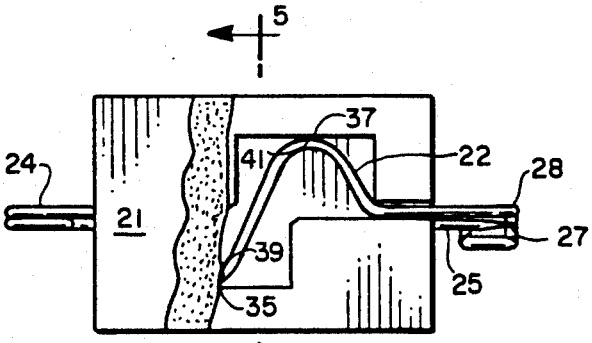
FIG. 4 is an elevational view of an assembled badge finding of the present invention.

More specifically, the cavity 16 having the S-shaped configuration prevents translational and rotational movement of pin 20 which has a like configuration. The prevention of rotational movements provides a security against accidental release of the pin 20. As shown in FIGS. 3 & 4, walls 31 and 33 of cavity 16 abut pin 20 in a manner preventing translational and rotational movement. More specifically, the pin portions 35 and 37 of the S-shaped portion 22 form a peak which abuts approximately with center of walls 31 and 33 at locations 39 and 41 respectively. The connection at 39 and 41 additionally prevent the pin 20 from translational movement about the cavity. The curved configuration of the pin portion 22 inserts into cavities 43 and 45 extending through the connection 47. The S-shaped configuration meshes consistently with the bottom of the cavity, and due to the S-shaped configuration, there is no common axis for pin 20 to rotate.

On the other side, a support rib 18 extends the entire length in the center along the axial direction of the backer body 14. Additionally, the backer body 14 has sufficient flexibility to conform to slight disfigurements of the display article. This flexibility prevents the backer body 14 from cracking and breaking off from the display article. Thus, the preferred backer body 14 has flexibility which enables the backer body 14 to be reliably attached to display articles.

The preferred pin means for the present invention is pin 20 of FIGS. 1 & 4. Pin 20 has generally four integrated portions made from a single piece of bent wire and are the S-shaped portion 22, a coil 24, a cantilever arm 25 and a hook 28. The pin 20 provides a combination that prevents translational movement and undesired release of the pin.

More specifically, the S-shaped portion 22 has a configuration designed for insertion into cavity 16 of the backer body 14. As described previously, the S-shaped portion tightly fits into slots 17 and 19 to insure against translational movement and to provide stability during assembly. Further, the S-shaped portion 22 extends through the rectangular cavities 43 and 45 of cavity 16 and abuts walls 31 and 33 at points 39 and 41 insuring against translational and rotational movement of the pin 20 about the cavity 16 to prevent accidental release caused by pin rotation. However, other configurations are possible, for example a triangular, curved, rectangular or square configuration is acceptable.

The coil 24 maintains pressure which insures that the pin stays fastened and allows for clearance between the cantilever arm 25 and the hook 28 for attachment to clothing purposes.

The cantilever arm 25 has a fixed end at coil 24 and a free end 27. The free end is biased in the hook 28 during attachment. This type of attachment places the free end 27 in the hook 28 in a manner where the coil 24 asserts constant pressure against the hook 28 that prevents the free end 27 from coming undone, unless a greater force is applied to the free end in the opposite direction. Overall, the cantilever arm 25 in cooperation with the free end 27 has two purposes which are for attachment, such as to clothing, and for closing the pin, where the hook 28 captures the free end 27 in a manner that insures against accidental release and provides for simple and safe fastening of the pin. This pin locked with the hook is preferred to the rotatable latch that has a slot to receive the pin end and then is rotated to hold the pin end in a locked position. Movement of the body and clothing tend to rotate the latch inadvertently to the open position. This rotatable latch is harder to pin onto a person than the hook style pin illustrated herein.

Figure 5:
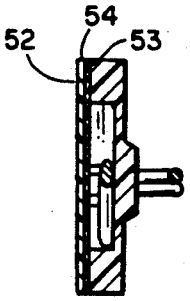
FIG. 5 is a cross-sectional view of the assembled badge finding embodying the principles of the present invention taken along the line 5—5 of FIG. 4.

The preferred adhesive means, as shown in FIG. 5, is an adhesive that has three laminate layers including a pair of adhesive layers 52 and 53, such as synthetic polymer based layers, separated by a liner 54, such as paper silicon, which provides secure attachment to the backer and the display article. Further, the preferred thickness of the three layers combined is 1/32 of an inch. The advantage of the double-sided adhesive 19 is in that it closes the cavity 16 thereby sealing the cavity 16 while securing pin 20 to the backer body 14. Secondly, the double-sided adhesive 19 allows the user the capability to simply peel of the paper-like backing, which covers the adhesive until usage, and affix the badge finding to the display article. The double-sided adhesive tape 19 can be either pre-cut or cut as needed for assembling the badge finding. Now referring to FIG. 1, the badge finding 12 of the present invention is easily assembled from the backer body 14, the pin 20 and the double-sided adhesive 19. First, the loop on pin 20 is inserted into the cavity 16 for receiving the S-shaped pin portion 22 that engages the cavity at walls 31 and 33. Next, the S-shaped pin portion 22 is pressed into the slots 17 and 19 which provide a tight fit between the S-shaped portion of pin 20 and the cavity 16 of backer body 14 for a secure attachment. Secondly, the double-sided adhesive 19 is placed over the cavity 16 to cover the same and to secure the pin to the backer body 14. In accordance with this procedure, the paper backing of the tape is peeled off to expose the adhesive means of the tape. Next, the exposed side of the tape is placed securely and firmly onto backer body 14 in a manner which completely covers the side having cavity 16. However, any standard double-sided adhesive can be employed with the present invention. These steps complete the assembling of the badge finding of the present invention.

In accordance with this invention, the badge finding 14 can easily be attached to any display article to be worn on clothing. To attach the badge finding 14, the badge face or article surface needs to be cleaned of any foreign particles or residue. For example, if using a metal plate for a badge face, the plate should be wiped off with a cleaning solution, such as alcohol. Next, the paper backing 21 of the second side of the double-sided adhesive 19 is removed, and the badge finding 14 is placed on the cleaned surface of the display article. The badge finding of the present invention is capable of being attached to display articles made from almost any material, such as wood, glass, metal, paper or cardboard. Generally, the badge finding 14 can be centered on display articles of ¾ inches or smaller in height; however, the badge finding should be placed toward the top of display articles larger than ¾ inches in height. Finally, the badge is associated with clothing using the free end 27 of the pin to thread the pin through the clothing. After the pin is threaded, the free end 27 of the pin is placed in the hook 28 to secure the badge to the clothing.

Thus, it will be seen that the objects hereinbefore set forth may readily and efficiently be attained; and, since certain changes may be made in the above construction and different embodiments of the invention without departing from the scope thereof, it is intended that all matter contained in the above description or shown in the accompanying drawings shall be interpreted as illustrative and not in a limiting sense.

We claim:

1. A badge finding for attachment to a display article including a badge, comprising:

a backer body having opposed sides with a cavity in one side, walls in said body defining the cavity, a locking pin of one piece wire having a central body portion and a coil at one end, and a hook at an opposite end of the central body portion, a free end on the locking pin for piercing clothing and for locking engagement with the hook, a cover for covering the cavity in the body and prohibiting the central body portion of the pin within the cavity from removal from the cavity, a first adhesive layer on one side of the cover adhering the cover to the side of the body to cover the cavity and the central body portion of the pin therein, a second adhesive layer on the other side of the cover for later affixing of the badge finding to the display article, and a liner adhesively secured to the second adhesive layer and peelable therefrom to expose the second adhesive layer at the time of affixing the badge finding to the display article.

2. An apparatus in accordance with claim 1 where the backer body is a high impact polystyrene.

3. An apparatus in accordance with claim 1 where the cavity has a predetermined configuration of an S-shape.

4. An apparatus in accordance with claim 1 where the central body portion has a configuration similar to the cavity of the backer body of an S-shape, for prohibiting rotation and translation about the backer body.

5. An apparatus in accordance with claim 1 where the first adhesive layer, the second adhesive layer, the cover and the liner comprise synthetic polymer base adhesive tape with a paper silicone liner.

6. A badge adapted to be pinned to an article of clothing to identify the wearer of the badges, said badge comprising:

a badge body having a flat, rear surface, a badge finding having a backer body with a cavity therein, a flat rear wall on the badge finding facing the badge body, an adhesive layer securing the backer body to the flat rear surface of the badge body, a locking pin forming of a one-piece integral wire, said pin having a central body portion of a general "S" shape mounted within the cavity of the backer body, said pin having a coil at one end of the central body portion of the wire pin, said pin having an integral hook on the other end of the body portion, said pin having a free cantilevered portion of the locking pin outside of the backer body and having a free end on the cantilevered portion for hooking engagement with the hook, and the cavity in the backer body being substantially in the shape of an "S" and receiving therein the generally "S" shaped central body portion of the locking pin.

* * * * *